United States Patent [19]

Espenhain

[11] Patent Number: 4,565,530

[45] Date of Patent: Jan. 21, 1986

[54] RECIPROCATING MARINE PROPULSION ENGINE

[76] Inventor: Donald L. Espenhain, 1671 Pasadena Dr., Dunedin, Fla. 33528

[21] Appl. No.: 557,832

[22] Filed: Dec. 5, 1983

[51] Int. Cl.[4] ..... A63B 35/00

[52] U.S. Cl. ..... 440/18; 440/13

[58] Field of Search ..... 440/18, 13, 42, 38; 114/150, 151

[56] References Cited

U.S. PATENT DOCUMENTS

| | | | |
|---|---|---|---|
| 829,681 | 8/1906 | Tambling | 440/18 |
| 1,094,184 | 4/1914 | Zimmerman | 440/18 |
| 1,461,691 | 7/1923 | Tulloch | 440/18 |
| 1,688,376 | 10/1928 | Bidoire | 440/18 |
| 2,056,475 | 10/1936 | Marx | 440/18 |
| 4,010,707 | 3/1977 | Bendall | 440/42 |
| 4,158,245 | 6/1979 | Cunningham | 440/18 |

FOREIGN PATENT DOCUMENTS

| | | | |
|---|---|---|---|
| 618868 | 3/1961 | Italy | 440/18 |

*Primary Examiner*—Trygve M. Blix
*Assistant Examiner*—C. T. Bartz
*Attorney, Agent, or Firm*—Stanley M. Miller

[57] ABSTRACT

A reciprocating marine propulsion engine is disclosed which includes a hollow, propulsion cylinder with a cylindrical axis, an intake end for admitting ambient water and an opposed discharge end for discharging water. A reciprocating shaft coaxial with the propulsion cylinder, transmits a reciprocating drive force. A ring member is mounted perpendicularly on a first end of the shaft and slideably engages the interior surface of the propulsion cylinder. Two semicircular vanes of a butterfly valve are pivotally mounted on the ring member for movement about an axis perpendicular to the cylindrical axis. A hollow ram cylinder has a first end mounted to and coaxial with the intake end of the propulsion cylinder, with a ram piston mounted on a second end of the shaft which slideably engages the interior surface of the ram cylinder. A first intake port on a second end of the ram cylinder opposite from the first end thereof, admits a working fluid during a thrust cycle, for applying a thrust force to move the ram piston in a thrust direction from the second end toward the first end of the ram cylinder. This moves the ring member from the intake end to the discharge end of the propulsion cylinder, the reactive force of the water within the propulsion cylinder causing the first and second vanes of the butterfly valve to close against the ring member, thereby forcing the water within the propulsion cylinder out through the discharge end thereof. This results in the application of a reactive propulsive force on the engine opposite to the thrust direction.

13 Claims, 11 Drawing Figures

FIG. 8
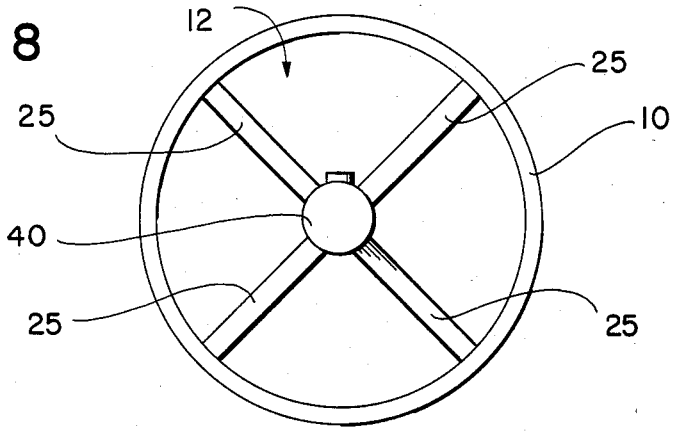
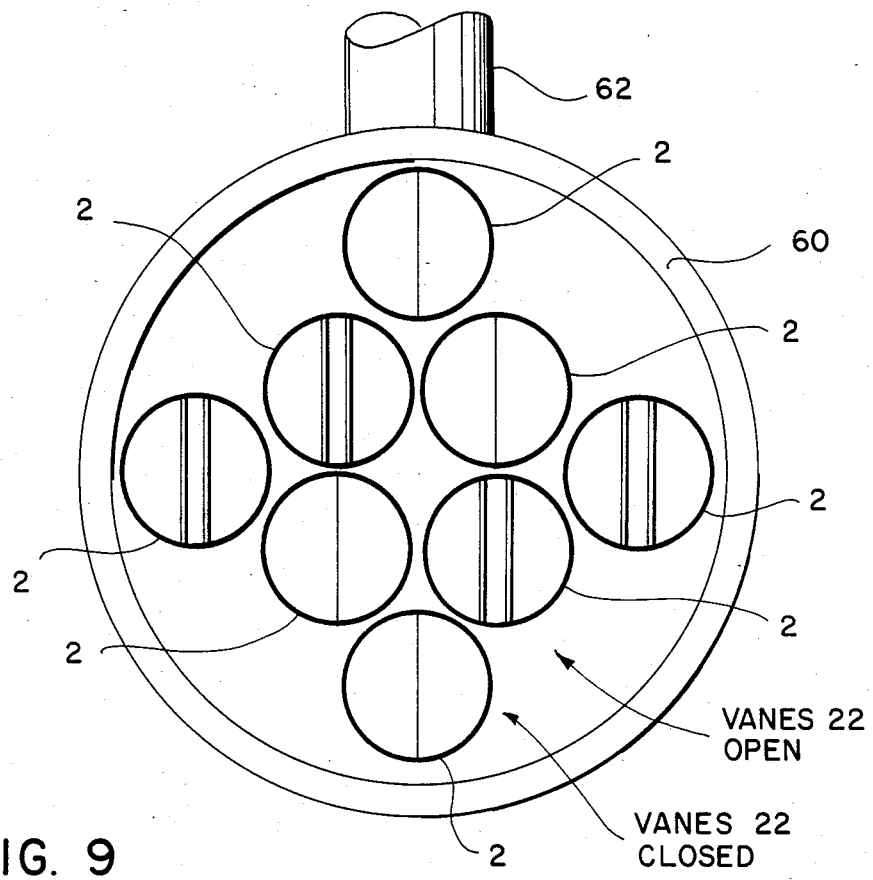
FIG. 9

RECIPROCATING MARINE PROPULSION ENGINE

FIELD OF THE INVENTION

The invention disclosed broadly relates to propulsion engines and more particularly relates to reciprocating marine propusion engines.

BACKGROUND OF THE INVENTION

From the time of the ancient Roman triremes, man has sought improved mechanisms of locomotion across the Earth's great bodies of water. Indeed, the oarsman was perhaps the first in the long line of reciprocating marine propulsion engines, pulling his oar through the water to obtain a reactive propulsive force in one direction, and then returning the oar with a minimum of resistance in the water to the beginning position for the next stroke.

Since those ancient times, many attempts have been made to improve on the reciprocating marine propulsion engine. For example, U.S. Pat. No. 1,688,376 to Bidoire discloses a relatively complicated mechanism for obtaining locomotion through water by means of a reciprocating propeller. Bidoire describes a multiple trap-door arrangement which is pushed and pulled through the water by means of a plurality of reciprocating arms which extend through the hull of the vessel to be propelled. The trap-doors are mounted to a rectangular frame and close during the thrusting portion of the cycle while opening to pass water with less resistance during the return portion of the cycle. A substantial amount of frictional loss of energy is suffered by the Bidoire apparatus through the work required to push and pull the driving rods through the stuffing boxes in the hull of the ship, which must be kept water-tight. The outrigger suspension of the trap-door frame by the drive rods undergoes great stresses in operation, which requires the use of large structural members to maintain the close dimensional tolerances required in the Bidoire design. In addition, the Bidoire device has a rectangular cross section which requires extensive machining to fabricate, making it an expensive assembly. The combination of low energy efficiency, excessive bulk and difficulty in fabrication have contributed to the inability of prior art reciprocating marine engines such as that of Bidoire's to successfully compete with other marine propulsion technologies.

OBJECTS OF THE INVENTION

It is therefor an object of the invention to provide a more efficient reciprocating marine propulsion engine than has been available in the prior art.

It is another object of the invention to provide a lighter reciprocating marine propulsion engine than has been available in the prior art.

It is a further object of the invention to provide a more economical reciprocating marine propulsion engine than has been available in the prior art.

SUMMARY OF THE INVENTION

These and other objects, features and advantages of the invention are accomplished by the improved reciprocating marine propulsion engine disclosed herein. A reciprocating marine propulsion engine is disclosed which includes a hollow, propulsion cylinder with a cylindrical axis, an intake end for admitting ambient water and an opposed discharge end for discharging water. A reciprocating shaft coaxial with the propulsion cylinder, transmits a reciprocating drive force. A ring member is mounted perpendicularly on a first end of the shaft and slideably engages the interior surface of the propulsion cylinder. Two semicircular vanes of a butterfly valve are pivotally mounted on the ring member for movement about an axis perpendicular to the cylindrical axis.

A hollow ram cylinder has a first end mounted to and coaxial with the intake end of the propulsion cylinder, with a ram piston mounted on a second end of the shaft which slideably engages the interior surface of the ram cylinder. A first intake port on a second end of the ram cylinder opposite from the first end thereof, admits a working fluid during a thrust cycle, for applying a thrust force to move the ram piston in a thrust direction from the second end toward the first end of the ram cylinder. This moves the ring member from the intake end to the discharge end of the propulsion cylinder, the reactive force of the water within the propulsion cylinder causing the first and second vanes of the butterfly valve to close against the ring member, thereby forcing the water within the propulsiuon cylinder out through the discharge end thereof. This results in the application of a reactive propulsive force on the engine opposite to the thrust direction.

A second intake port on the first end of the ram cylinder is for admitting a working fluid during a return cycle, for applying a return force to move the ram piston in a return direction from the first end to the second end of the ram cylinder, causing the shaft to transmit the return force to the ring member. This moves the ring member from the discharge end to the intake end of the propulsion cylinder. Then the reactive force of the water within the propulsion cylinder causes the first and second vanes of the butterfly valve to open away from the ring member, thereby allowing the ring to move through the water within the propulsion cylinder without applying any substantial force thereto.

A stop member can be mounted to the first vane, for contacting the second vane when the first and second vanes are open, thereby preventing the first and second vanes from overlapping.

A plurality of the engines can be mounted in a thrust housing with their respective cylindrical axes mutually parallel. A steering shaft is mounted to the thrust housing, for supporting the housing. The steering shaft can be mounted to the hull of a marine vessel to be propelled through the water.

The steering shaft can be mounted for rotation about its shaft axis, to steer the vessel by directing the thrust from the engines in the housing in a selected direction with respect to the longitudinal axis of the vessel. In addition, the steering shaft can be pivotally mounted to the hull of the vessel about an axis perpendicular to the steering shaft axis, for pivotally lifting the housing out of the ambient water.

The resultant reciprocating marine propulsion engine eliminates the need for all main engines, gears, screw propellers, rotary shafts and rudders which are required in conventional propulsion systems. The invention is less expensive to manufacture than prior art designs because many of the parts can be made from structural plastic tubing and from molded plastics. The invention is more efficient than conventional internal combustion engines because there are fewer moving parts required and the dimensional tolerances between the parts is not as tight, thus there is less frictional dissipation of energy. The invention has a higher thrust to weight ratio than do prior art marine propulsion engines. The engine is versatile and serves both as a forward propulsion device and as a side thruster to assist in docking operations. Since the engine is mounted outside the hull of the vessel, it frees additional cargo space within the vessel, it reduces the noise level in the vessel and it provides for a safer operation.

DESCRIPTION OF THE FIGURES

These and other objects, features and advantages of the invention will be more fully appreciated with reference to the accompanying figures.

FIG. 8 is a back view of the ram cylinder 40 mounted on the propulsion cylinder 10 by means of the brackets 25.

FIG. 9 is a front view of a plurality of the marine propulsion engines 2 mounted in a cluster within the thrust housing 60.

DISCUSSION OF THE PREFERRED EMBODIMENT

Figure 1:
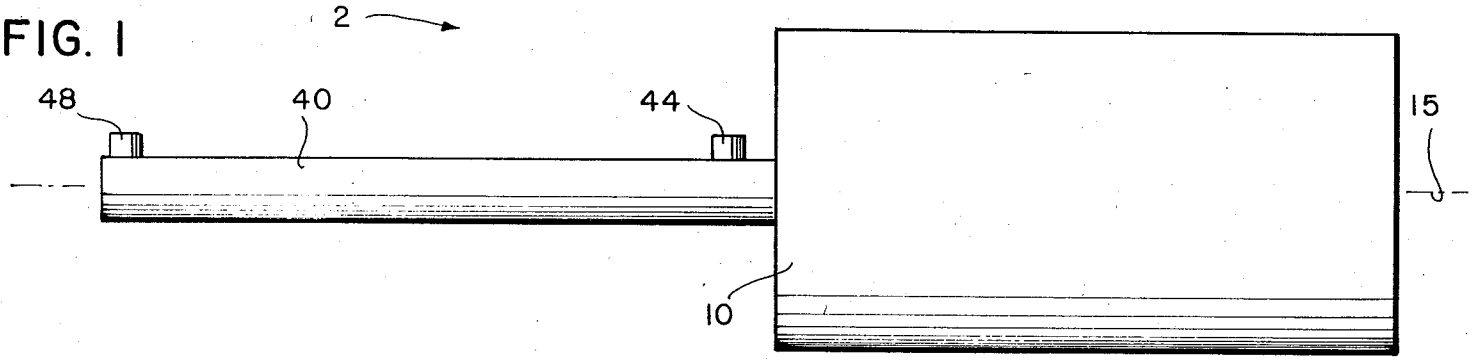
FIG. 1 is a side view of the marine propulsion engine.
Figure 2:
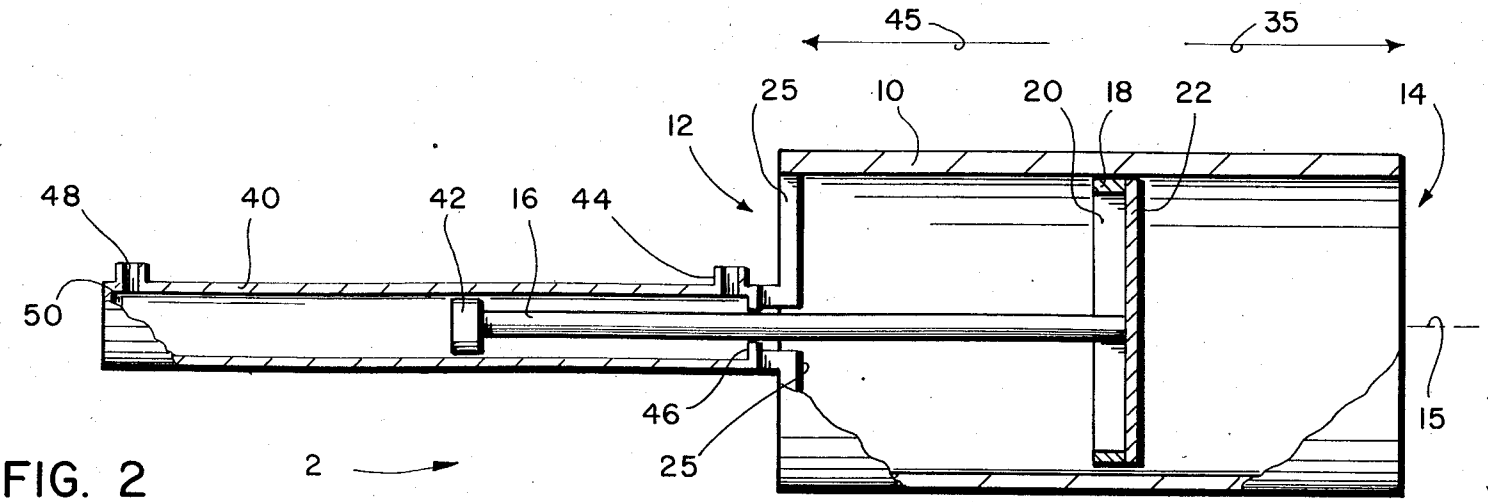
FIG. 2 is a side, break-away view of the engine of FIG. 1.

The marine propulsion engine 2 shown in FIGS. 1 and 2 includes a hollow, propulsion cylinder 10 having a substantially circular cross section as is shown in FIG. 8, with a cylindrical axis 15, an intake end 12 for admitting ambient water thereto and an opposed discharge end 14 for discharging water into the ambient.

A reciprocating shaft 16 shown in FIG. 2, is coaxial with the propulsion cylinder 10, for transmitting a reciprocating drive force.

Figure 4:
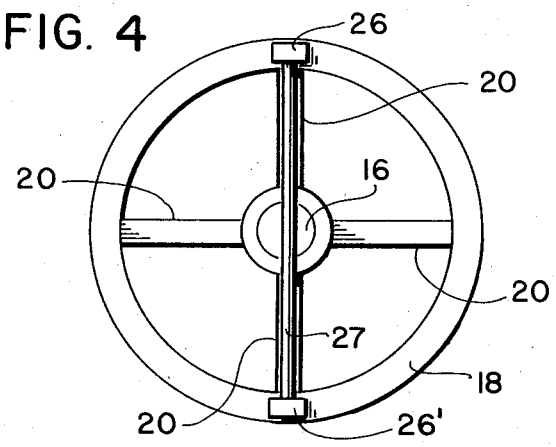
FIG. 4 is a front view of the ring 18.
Figure 3:
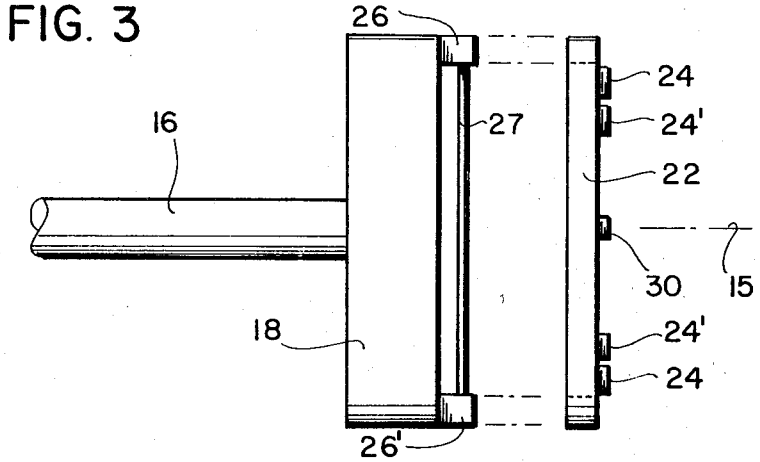
FIG. 3 is a side view of the ring 18 and butterfly valve vane 22.

A ring member 18 shown in FIGS. 3 and 4, is mounted perpendicularly by spoke elements 20 on a first end of the reciprocating shaft 16 and slideably engages the interior surface of the propulsion cylinder 10.

A first semicircular vane 22 of the butterfly valve shown in FIGS. 3, 5, 6 and 7, has a diametric side pivotally mounted on the ring member 18 for pivotal movement about a pivot rod 27 perpendicular to the cylindrical axis 15, the pivotal movement being on the opposite side of the ring member 18 from the reciprocating shaft 16. Pivot mounts 26 and 26' on the ring 18 support the pivot rod 27. The hinge portions 24 on the vane 22 are pivotally mounted on the pivot rod 27. The hinge portions 24' on the vane 22' are pivotally mounted on the pivot rod 27. The vane 22 can be molded from a plastic material and the hinge portions 24 can be integrally formed as a part of the vane 22. There can be a plurality of hinge portions 24 and 24' and of pivot mounts 26 extending along the entire length of the pivot rod 27 to provide additional strength to the butterfly valve.

Figure 7:
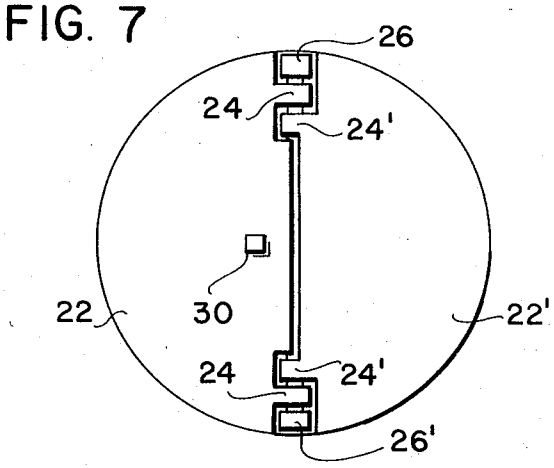
FIG. 7 is a front view of the butterfly valve vanes 22 and 22'.

The second semicircular vane 22' of the butterfly valve of FIG. 7, has a diametric side pivotally mounted on the ring member 18 for pivotal movement about the pivot rod 27 perpendicular to the cylindrical axis 15. The hinge portions 24' on the vane 22' are pivotally mounted on the pivot rod 27. The vane 22' can be molded from a plastic material and the hinge portions 24' can be integrally formed as a part of the vane 22'. The pivotal movement is on the opposite side of the ring member 18 from the reciprocating shaft 16.

FIG. 2 shows a hollow ram cylinder 40 having a first end 46 mounted to and coaxial with the intake end 12 of the propulsion cylinder 10. A ram piston 42 is mounted on a second end of the reciprocating shaft 16 and slideably engages the interior surface of the ram cylinder 40.

Figure 6:
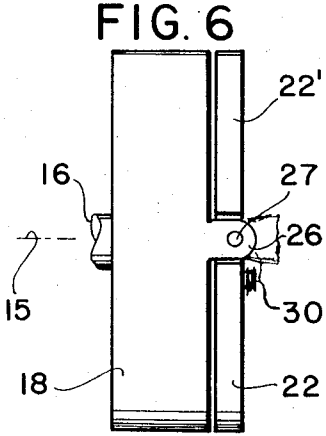
FIG. 6 is a top view of the ring 18 and the butterfly valve vanes 22 and 22' in their closed position.

FIG. 2 further shows a first intake port 48 on the second end 50 of the ram cylinder 40 opposite from the first end 46 thereof, for admitting a working fluid such as steam, during a thrust cycle. The working fluid admitted into the first intake port 48 will apply a thrust force to move the ram piston 42 in a thrust direction 35 from the second end 50 toward the first end 46 of the ram cylinder 40. This will cause the shaft 16 to transmit the trust force to the ring member 18, moving the ring member 18 from the intake end 12 to the discharge end 14 of the propulsion cylinder 10. The reactive force of the water within the propulsion cylinder 10 causes the first and second vanes 22 and 22' of the butterfly valve to close against the ring member 18, as shown in FIG. 6. In this manner, the water within the propulsion cylinder 10 is forced out through the discharge end 14 thereof, resulting in the application of a reactive propulsive force on the engine 2 opposite to the thrust direction 35.

Figure 5:
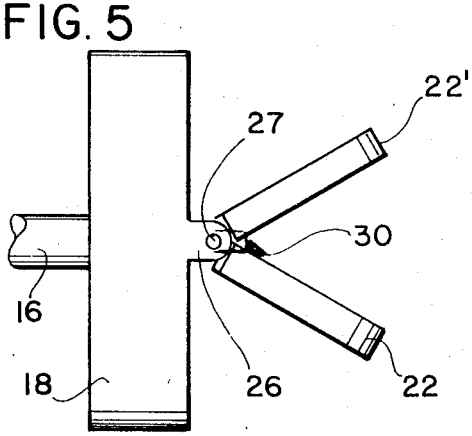
FIG. 5 is a top view of the ring 18 and butterfly valve vanes 22 and 22' in their open position.

A second intake port 44 is shown in FIG. 2, on the first end 46 of the ram cylinder 40 for admitting the working fluid during a return cycle, for applying a return force to move the ram piston 42 in a return direction 45 from the first end 46 to the second end 50 of the ram cylinder 40. This causes the shaft 16 to transmit the return force to the ring member 18, moving the ring member 18 from the discharge end 14 to the intake end 12 of the propulsion cylinder 10. The reactive force of the water within the propulsion cylinder 10 causes the first and second vanes 22 and 22' of the butterfly valve to open away from the ring member 18, as shown in FIG. 5. In this manner, the ring 18 is allowed to move through the water within the propulsion cylinder 10 without applying any substantial force thereto.

FIGS. 5 and 7 show a stop member 30 mounted to the ring 18 with pivot rod 26 going through it, for keeping the first and second vanes open to 87°, thereby preventing the first and second vanes from overlapping, and to provided positive closing.

Great advantage can be derived from clustering a plurality of the marine propulsion engines 2 in a thrust housing 60 such as is shown in FIG. 9. The engines 2 can be mounted with their respective cylindrical axes 15 mutually parallel.

Figure 10:
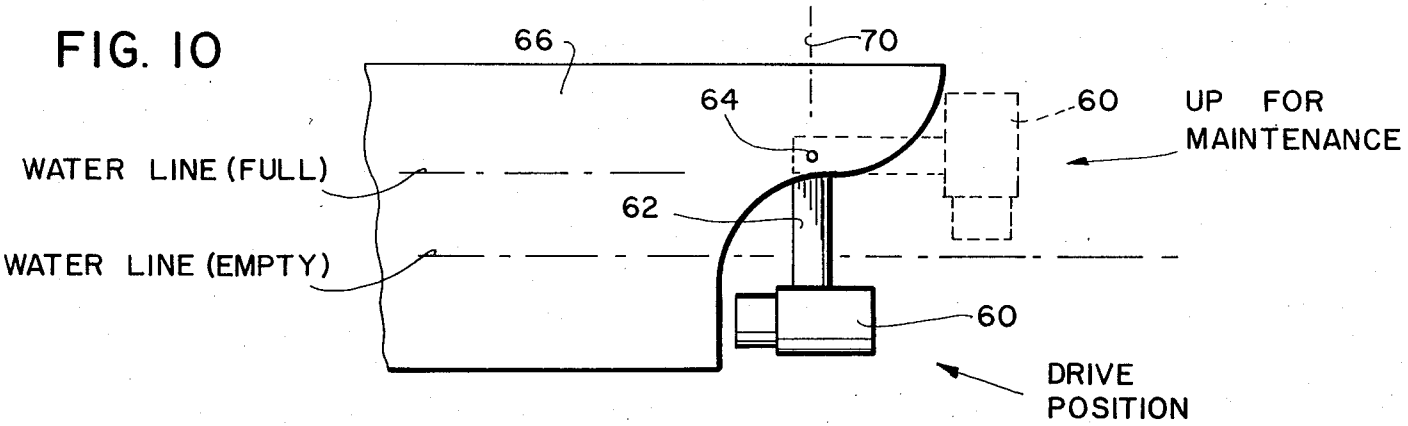
FIG. 10 is a side view of the hull 66 of a marine vessel with its steering shaft 62 supporting the thrust housing 60.
Figure 11:
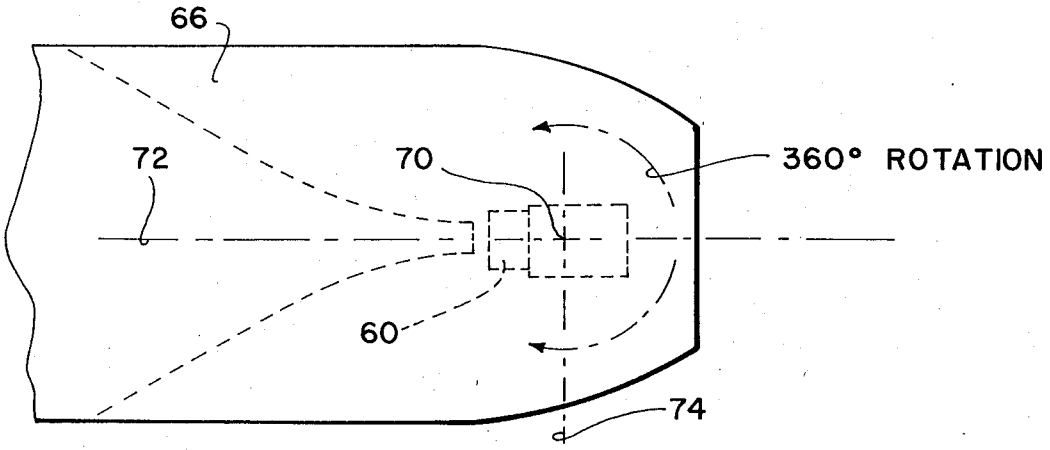
FIG. 11 is a top view of the hull 66 of FIG. 10.

As is shown in FIG. 10, a steering shaft 62 is mounted to the thrust holding 60, for supporting the housing 60. The steering shaft 62 is mounted to the hull 66 of a marine vessel to be propelled through the water. The steering shaft 62 is mounted for rotation about its shaft axis 70, to steer the vessel by directing the thrust from the engines in the thrust housing 60 in a selected direction coinciding with the axes 15 of the respective engines 2, with respect to the longitudinal axis 72 of the vessel. In order to service and repair the engines 2 in the thrust housing 60, the steering shaft 62 is pivotally mounted at 64 to the hull 66 of the vessel about an axis 74 perpendicular to the steering shaft axis 70, for pivotally lifting the housing 60 out of the ambient water.

The respective engines 2 can be controlled so that a first subplurality of the engines 2 in the housing 60 are in the thrust cycle while a second subplurality of the engines 2 in the housing 60 are in the return cycle.

The working fluid can be steam in the preferred embodiment, but in alternate embodiments the working fluid can be a hydraulic fluid or a pneumatic fluid.

The composition of the propulsion cylinder 10 can be formed from a plastic tubing which can be selected, for example, from the group consisting of polyvinyl chloride and acrylonitrile butadiene styrene.

The composition of the first and second vanes 22 and 22' can be composed of a plastic material which can be selected, for example, from the group consisting of polyvinyl chloride and acrylonitrile butadiene styrene.

The ram cylinder 40 in each engine 2 can be powered by steam supplied from a rotary valve which is programmed to alternately apply the working fluid to the first port 48 and then to the second port 44 in a cylic manner at a selected rate, to thereby control the speed and the power of the engine 2.

The resultant reciprocating marine propulsion engine eliminates the need for all main engines, gears, screw propellers, rotary shafts and rudders which are required in conventional propulsion systems. The invention is less expensive to manufacture than prior art designs because many of the parts can be made from structural plastic tubing and from molded plastics. The invention is more efficient than conventional internal combustion engines because there are fewer moving parts required and the dimensional tolerances between the parts is not as tight, thus there is less frictional dissipation of energy. The invention has a higher thrust to weight ratio than do prior art marine propulsion engines. The engine is versatile and serves both as a forward propulsion device and as a side thruster to assist in docking operations. Since the engine is mounted outside the hull of the vessel, it frees additional cargo space within the vessel, it reduces the noise level in the vessel and it provides for a safer operation.

Thus the resultant invention will provide a more efficient reciprocating marine propulsion engine than has been available in the prior art. The invention provides a lighter reciprocating marine propulsion engine than has been available in the prior art. And the invention provides a more economical reciprocating marine propulsion engine than has been available in the prior art.

What is claimed is:

1. A marine propulsion engine, comprising:

a thrust housing enclosing a plurality greater than two of engines mounted with their respective thrust axes mutually parallel;

said thrust housing being substantially cylindrical in configuration and having a longitudinal axis of symmetry;

said engines being disposed within said housing in radial relation to the longitudinal axis of symmetry of said housing and in circumferentially spaced relation to one another;

a steering shaft mounted to said thrust housing, for supporting said housing;

said steering shaft being mounted to the hull of a marine vessel to be propelled through the water;

said steering shaft being mounted for rotation about its shaft axis, to steer said vessel by directing the thrust from said engines in said housing in a selected direction with respect to the longitudinal axis of said vessel;

each of said engines comprising:

a hollow propulsion cylinder having a substantially circular cross section with a cylindrical axis, an intake end for admitting ambient water thereinto and an opposed discharge end for discharging water into the ambient;

a reciprocating shaft coaxial with said propulsion cylinder, for transmitting a reciprocating drive force;

a ring member mounted perpendicularly by spoke elements on a first end of said reciprocating shaft and slideably engaging the interior surface of said propulsion cylinder;

a first semicircular vane of a butterfly valve, with a diametric side pivotally mounted on said ring member for pivotal movement about a pivot axis perpendicular to said cylindrical axis, said pivotal movement being on the opposite side of said ring member from said reciprocating shaft;

a second semicircular vane of a butterfly valve, with a diametric side pivotally mounted on said ring member for pivotal movement about said pivot axis perpendicular to said cylindrical axis, said pivotal movement being on the opposite side of said ring member from said reciprocating shaft;

a hollow ram cylinder having a first end mounted to and coaxial with said intake end of said propulsion cylinder, having a ram piston mounted on a second end of said reciprocating shaft and slideably engaging the interior surface of said ram cylinder;

a first intake port on a second end of said of said ram cylinder opposite from said first end thereof, for admitting a working fluid during a thrust cycle, for applying a thrust force to move said ram piston in a thrust direction from said second end toward said first end of said ram cylinder, causing said shaft to transmit said thrust force to said ring member, moving said ring member from said intake end to said discharge end of said propulsion cylinder, the reactive force of the water within said propulsion cylinder causing said first and second vanes of said butterfly valve to close against said ring member, thereby forcing the water within said propulsion cylinder out through said discharge end thereof, resulting in the application of a respective propulsive force on said engine opposite to said thrust direction;

a second intake port on said first end of said ram cylinder for admitting a working fluid during a return cycle, for applying a return force to move said ram piston in a return direction from said first end to said second end of said ram cylinder, causing said shaft to transmit said return force to said ring member, moving said ring member from said discharge end to said intake end of said propulsion cylinder, the reactive force of the water within said propulsion cylinder causing said first and second vanes of said butterfly valve to open away from said ring member, thereby allowing said ring member to move through the water within said propulsion cylinder without applying any substantial force thereto;

a first subplurality of said engines in said housing being in a thrust cycle while a second subplurality of said engines in said housing are in said return cycle.

2. The apparatus of claim 1, wherein said working fluid is steam.

3. The apparatus of claim 1, wherein said working fluid is a hydraulic fluid.

4. The apparatus of claim 1, wherein said working fluid is a pneumatic fluid.

5. The apparatus of claim 1, wherein each of said propulsion cylinders is formed from a plastic tubing.

6. The apparatus of claim 5, wherein said plastic is selected from the group consisting of polyvinyl chloride and acrylonitrile butadiene styrene.

7. The apparatus of claim 1, wherein said first and second vanes are composed of a plastic material.

8. The apparatus of claim 7, wherein said plastic is selected from a group consisting of polyvinyl chloride and acrylonitrile butadiene styrene.

9. A marine propulsion engine of the type having slideably mounted butterfly valves which open and close within a cylinder attendant a return and a thrust stroke, respectively, wherein the improvement comprises:

a cylindrical housing member;

a plurality greater than two of said engines mounted within said housing member;

said engines having their respective axes of symmetry disposed in parallel alignment with one another; and said engines disposed in radial relation to the longitudinal axis of symmetry of said housing member and in circumferentially spaced relation to one another so that said engines cooperate with one another to provide a propulsive force, the strokes of the respective engines cooperating with one another so as to impart a centerline thrust to a vessel propelled by said engines.

10. The engine of claim 9, wherein there are two concentric arrays of said engines within said housing member.

11. The engine of claim 10, wherein there are four circumferentially spaced engines in a first, outer array of engines within said housing member, and four circumferentially spaced engines in a second, inner array of engines within said housing member.

12. The engine of claim 11, wherein diametrically opposite engines in said first, outer array are in the same stroke, whether return or thrust, at the same time, and circumferentially adjacent engines are in opposite strokes at the same time.

13. The engine of claim 11, wherein diametrically opposite engines in said second, inner array are in the same stroke, whether return or thrust, at the same time, and circumferentially adjacent engines are in opposite strokes at the same time.

* * * * *